United States Patent [19]

Palmer et al.

[11] Patent Number: 5,008,667

[45] Date of Patent: Apr. 16, 1991

[54] SAFETY SYSTEM FOR BOATS IN DRY STORAGE

[76] Inventors: Larry R. Palmer, Rt. 2, P.O. Box 397-X1, Harriman, Tenn. 37748; Joseph M. Collins, Rt. 4, Box 561, Lenoir City, Tenn. 37771; Gary M. Holloway, Rte. 2, Box 423A, Vonore, Tenn. 37885

[21] Appl. No.: 498,971

[22] Filed: Mar. 26, 1990

[51] Int. Cl.[5] ..... G08B 23/00

[52] U.S. Cl. ..... 340/984; 114/263; 340/636

[58] Field of Search ..... 340/984, 942, 932.2, 340/636, 455; 114/263, 264; 116/26; 342/23; 414/231, 232; 55/603

[56] References Cited

U.S. PATENT DOCUMENTS 4,070,979 1/1978 Otis et al. ..... 114/263

4,843,639 6/1989 Beals ..... 455/603

*Primary Examiner*—Joseph A. Orsino

*Assistant Examiner*—Brent A. Swarthout

*Attorney, Agent, or Firm*—Pitts and Brittian

[57] ABSTRACT

A safety system for use with boats to be stored in enclosed buildings to minimize potential problems of fires and explosions. This system has a transmitting unit for attachment to the boat itself which is energized when the electrical distribution system of the boat is energized. This transmnitting unit generates a signal indicating this energized state. A receiving unit associated with the building receives any output signal of the transmitting unit and sounds an alarm when this output signal is detected by the receiving unit. In the preferred form, the transmitting unit and the receiving unit utilize infrared light as the generated and received signal. Also in the preferred embodiment, the detector unit has a plurality of detector elements arranged along the side and top edges of a doorway leading into the storage facility. As a result of this system it can be assured that no boat with an energized electrical distribution system is stored within the facility.

11 Claims, 2 Drawing Sheets

SAFETY SYSTEM FOR BOATS IN DRY STORAGE

FIELD OF INVENTION

This invention relates to alarm systems, and more particularly an alarm system to provide for the safety of boats placed in buildings for dry storage, repair, etc.

BACKGROUND ART

It is conventional practice at many boat marinas throughout the world to provide inside storage for the boats during periods of non-use. Generally this indoor storage is provided for medium-sized boats from twenty-one to thirty feet in length, although boats of other sizes are often stored indoors. This storage is referred to as "dry storage". Some buildings may contain up to 250 boats, or more, during the storage season. Still other indoor facilities may be used for performing maintenance and repair.

A serious problem that exists in this indoor storage is that of the potential for fire and explosion. The boats in storage often have a significant amount of fuel, usually gasoline. Further, engines can often drip some gasoline into the bilge. Since the boats have blowers, heaters and other electrical equipment that may still be activated from the boat battery during the storage period, excessive heat and even sparks can occur. It is for this reason that insurance rates for the storage operator have been extremely high, often $40,000 to 50,000 per year for large storage facilities. At present the only method known to minimize this problem is for the owner of the boat, or the personnel of the storage facility, to disconnect the battery system from the rest of the electrical system of the boat. While this is often done, there is always the possibility that the disconnect is overlooked or that the owner may, for some reason, reconnect the battery before removing the boat from storage, as for testing various electrical equipment while still in dry storage.

Accordingly, it is an object of the present invention to provide a safety system for the indoor storage of boats that will automatically sound an alarm whenever a boat entering the storage facility, or stored therein, has an activated electrical system.

It is another object of the present invention to provide a safety unit for permanent installation on boats that will be stored that will transmit a signal when the electrical system of the boat is activated, with a receiving station associated with the storage facility to provide an alarm when a boat is to be stored (or is stored) with an activated electrical system.

A further object of the present invention is to provide an infra-red sending unit on each boat that will be stored, with an infra-red receiving unit associated with the storage facility that will activate an alarm such that personnel of the facility will be advised of the presence of a boat having an activated electrical system.

Another object of the present invention is to provide an inexpensive and positive safety system for the storage of boats within buildings used for dry storage, maintenance, etc.

These and other objects of the present invention will become apparent upon a consideration of the drawings referred to below and to a complete description thereof that follows.

DISCLOSURE OF THE INVENTION

In accordance with the present invention, there is provided a safety system to be used in conjunction with boats to be placed in indoor storage that provides an audible (and possibly a visual) alarm whenever the electrical system of the boat is activated. This safety system includes a unit for installation on the boat itself that provides a signal whenever the electrical system of the boat is activated, and a receiving unit associated with the storage building that detects the signal from the boat, when present, and sounds an alarm such that the electrical system of the boat can be deenergized. In the preferred form, the unit on the boat includes a disconnect switch in series with the lead from the battery system to the remainder of the electrical system, and at least one infra-red transmitter on the boat that is activated whenever the electrical system is activated. The preferred unit associated with the storage facility comprises a plurality of infra-red detectors located at the entrances to the building so as to intercept any signals generated from the boat itself. This receiving unit sounds an audible alarm whenever one or more of the detectors is activated from a signal from the sending units on the boat.

BEST MODE FOR CARRYING OUT THE INVENTION

Figures 1A, 1B:
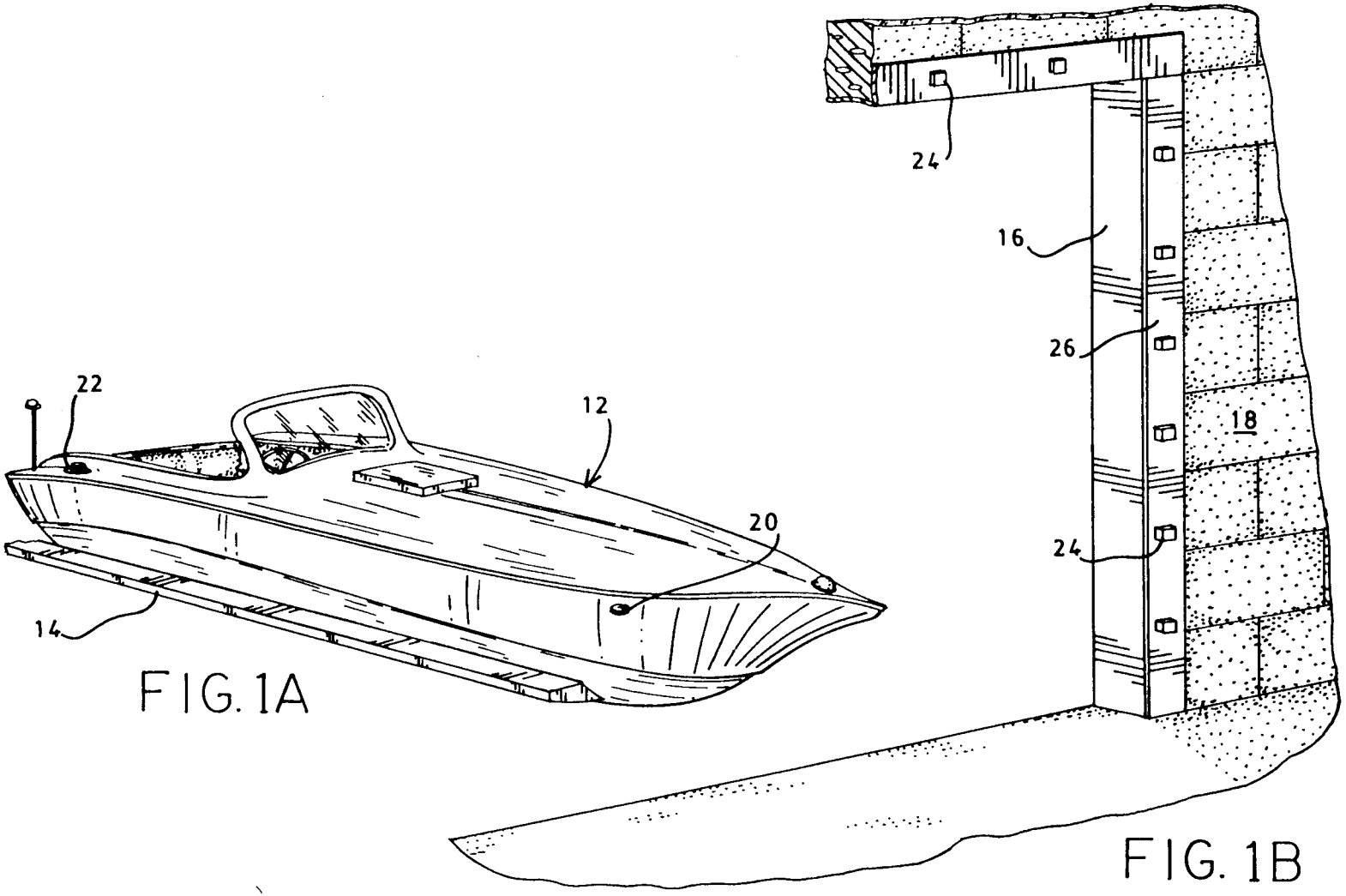
FIG. 1 is a drawing depicting a boat being moved into an indoor storage facility with the units of the safety system illustrated on the boat and at the doorway of the building.

The general relationship of the components of the safety system of the present invention can be seen by referring to FIG. 1. This depicts a boat 12, as supported upon the forks 14 of a fork-lift truck (not shown) being moved through a doorway 16 of a storage building 18. Shown mounted on the boat 12 is a starboard transmitting element 20. Typically there would be a port transmitting element also (see FIG. 2). It will be understood that while the transmitting element 20 is shown as being mounted proximate the gunwale (junction between the deck and the hull of the boat), it can be mounted at any position where a signal therefrom can be detected. Also, the present invention is not limited to a pair of transmitters as it can utilize only one transmitter or more than the two transmitters.

Also shown in this FIG. 1 is a disconnect switch 22 which, preferably, is mounted such that it can be easily operated by either the boat owner or by personnel of the storage facility. This switch will be discussed in connection with the circuit diagram of FIG. 2.

Positioned at selected spacings around the periphery of the doorway 16 are a plurality of detector elements 24 that are responsive to the signals generated by the transmitter(s) 20 on the boat 12. The spacing and the number of detectors will depend upon the distribution of the signals from the transmitter(s) 20. Typically, the detectors 24 will be spaced apart about eighteen inches; however, this can range from about twelve inches to about twenty-four inches. Typically these detectors can be mounted on the interior door facing 26 of the doorway 16. Of course, additional detectors could be mounted at other doorways or at other locations throughout the building 18.

Figure 2:
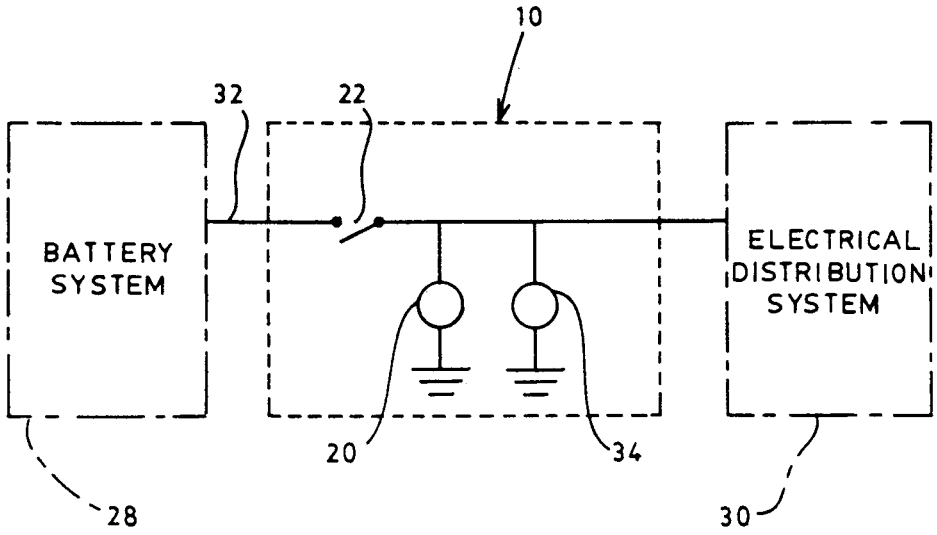
FIG. 2 is a schematic drawing illustrating the portion of the safety system that is installed on the boat.

Referring now to FIG. 2, shown therein is a schematic circuit diagram for a unit 10 that is installed on the boat 12. Shown in phantom lines are the conventional battery circuit 28 and the conventional electrical distribution system 30. This unit 10 can be used for boats having either single or dual batteries as it is connected into the conventional cable 32 normally connecting the battery system to the distribution system. The unit includes the afore-mentioned disconnect switch 22 which typically is a single-pole, single-throw switch such as Model M-284 available from Cole Hersee, a manufacturer of numerous types of marine equipment. As stated above, this switch preferably is mounted on the boat at a location where it is easily operated by either the owner while preparing the boat for dry storage, or by personnel of the storage facility as they move the boat into the storage building. When this switch 22 is in the closed position, for energizing the electrical distribution system 30 from the battery system 28, the starboard transmitting unit 20 and the port transmitting unit 34 are energized. Typically these transmitters are infra-red emitters such as Model SM31E units available from Banner Engineering Corporation of Minneapolis, MN, although other types of sending units can be used. As stated above, the invention is not limited to the number of transmitting units: only two being depicted in this FIG. 2. These particular infra-red transmitters emit light within a cone of about ten degrees so that detectors at the facility doorway 16 can have a reasonable spacing as discussed.

Figure 3:
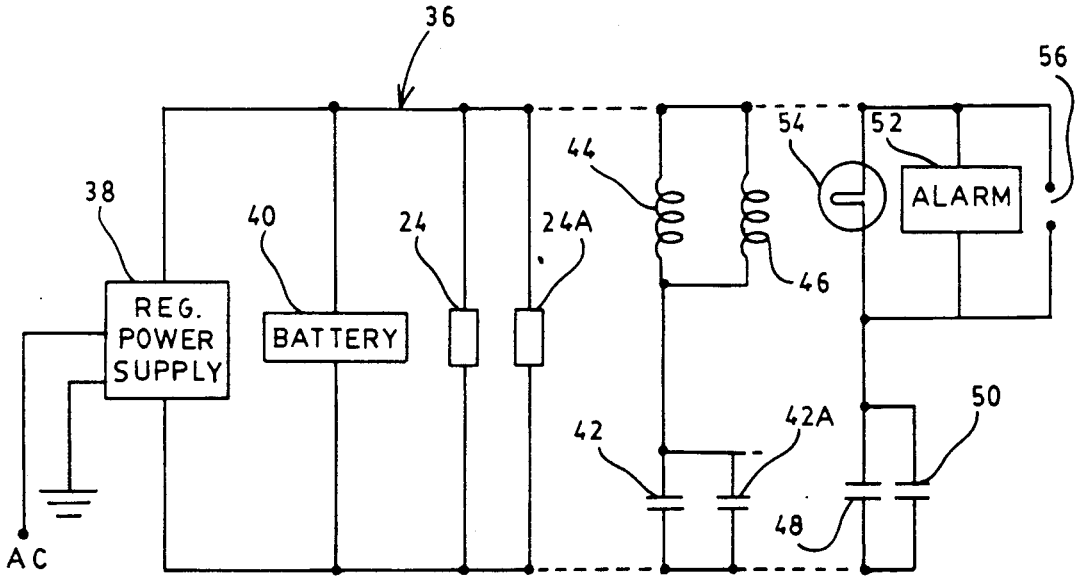
FIG. 3 is a schematic drawing illustrating the portion of the safety system that is installed in the storage building.

A schematic circuit diagram of a facility detector unit 36 is shown in FIG. 3. A regulated power supply 38, having an AC voltage input, provides a DC output substantially matching that of a battery 40. If desired, the battery can be connected into the circuit only upon the failure of the AC voltage input. The DC voltage powers the various detectors 24, 24A, etc. which typically are infra-red detectors Model 5M31 as available from the aforementioned Banner Engineering Corporation. If other types of sending units are used, the detectors are chosen to match the sending units. The number of detectors will depend upon the particular installation at the storage facility. Each detector has associated therewith a normally open contact as indicated at 42, 42A, etc. When any of these detector contacts close, a relay 44 is energized. For safety, a second relay 46 is shown. These relays, in turn, operate normally open contacts 48, 50, respectively. Closure of either contact 48 or 50 causes the energization of an alarm 52 and, optionally, a warning light 54. The alarm can be a horn, a bell, a siren, etc., and the light can be of the flashing type. Other types of warning devices can be connected at 56. Thus, upon the detection of a signal generated on a boat having an activated electrical distribution system, an alarm is generated so that corrective action can be taken. This will occur as boats are moved into the storage facility or at any time the electrical system of a boat is activated while within the storage facility.

Although the transmitting unit 10 is primarily intended for permanent installation on the boat 12, temporary installation can be utilized to provide the safety system of the present invention. As such, a single sending unit 20 and the disconnect switch 22 can be mounted in a module (not shown) for temporary attachment into the electrical system of the boat. This may be most practical for boats that are substantially open where connections to the battery system are easily made.

From the foregoing, it will be understood by persons skilled in the art that a very simple and effective safety system has been provided to be used in connection with the storage of boats within enclosed facilities. This safety system assures that any boat being moved into the closed facility has the electrical system thereof de-energized so as to minimize fire and explosion potential within the facility. Further, should the electrical system of the boat be energized for any reason while within the facility, the alarm will be activated to alert storage personnel that a potentially dangerous condition has been created. This safety system should be of great assistance in reducing the potential hazards and thus in reducing insurance premiums paid for such boat storage facilities.

While only certain embodiments of the present invention have been shown and described, these embodiments are not intended for the limitation of the present invention for other components are contemplated within the scope of the invention. For example, other forms of transmitters and receivers can certainly be utilized in the invention. Rather, the invention is to be limited only by the appended claims and their equivalents when taken together with the detailed description of the invention as set forth above.

We claim:

1. A safety system for use with boats stored within an enclosed building, which comprises:

a transmitting unit for attachment to said boats, said transmitting unit interposed between a battery system and an electrical distribution system of said boats, said transmitting unit including a disconnect switch means for selectively interrupting connection between said battery system and said electrical distribution system and further including at least one signal transmitting unit to generate an output signal when said battery system is connected to said electrical distribution system by said disconnect switch means; and a receiving unit associated with said enclosed building, said receiving unit having at least one detector unit for receiving said output signal of said signal transmitting unit, said receiving unit further having a power supply means for said detector unit and an alarm means connected to said detector unit for generating an alarm signal whenever said detector unit detects said output signal from said signal transmitting unit.

2. The safety system of claim 1 wherein said disconnect switch means is a mechanical switch interposed between said battery system and said electrical distribution system of said boat.

3. The safety system of claim 1 wherein said transmitting unit has at least two signal transmitting units, with at least one signal transmitting unit mounted on each side of said boat.

4. The safety system of claim 1 wherein said at least one signal transmitting unit is an infra-red emitter unit for generating an infra-red light, and said detector unit of said receiving unit is an infra-red sensitive detector.

5. The safety system of claim 1 wherein said receiving unit has a plurality of detector units mounted along side and top edges of a doorway leading into said enclosed building.

6. A safety system for use with boats stored within an enclosed building, which comprises:

a transmitting unit for attachment to said boats, said transmitting unit interposed between a battery system and an electrical distribution system of said boats, said transmitting unit including a disconnect switch means for selectively interrupting connection between said battery system and said electrical distribution system and further including at least one infra-red emitting unit to generate infra-red light when said battery system is connected to said electrical distribution system by said disconnect switch means; and a receiving unit associated with said enclosed building, said receiving unit having at least one infra-red detector unit for receiving said infra-red light of said infra-red emitting unit, said receiving unit further having a power supply means for said detector unit and an alarm means connected to said detector unit for generating an alarm signal whenever said detector unit detects said infra-red light from said infra-red emitting unit.

7. The safety system of claim 6 wherein said disconnect switch means is a mechanical switch interposed between said battery system and said electrical distribution system of said boat.

8. The safety system of claim 6 wherein said transmitting unit has at least two infra-red emitting units, with at least one infra-red emitting unit mounted on each side of said boat.

9. The safety system of claim 6 wherein said receiving unit has a plurality of infra-red detector units mounted along side and top edges of a doorway leading into said enclosed building.

10. A safety system for use with boats stored within an enclosed building, which comprises:

a transmitting unit for attachment to said boats, said transmitting unit interposed between a battery system and an electrical distribution system of said boats, said transmitting unit including a mechanical disconnect switch means for selectively interrupting connection between said battery system and said electrical distribution system and further including at least one infra-red emitting unit to generate infra-red light when said battery system is connected to said electrical distribution system by said disconnect switch means; and a receiving unit associated with said enclosed building, said receiving unit having a plurality of infra-red detector units for receiving said infra-red light of said infra-red emitting unit, said infra-red detector units arranged along side and top edges of a doorway leading to said enclosed building, said receiving unit further having a power supply means for said detector units and an alarm means connected to said detector units for generating an alarm signal whenever a detector unit detects infra-red light from said infra-red emitting unit.

11. The safety system of claim 10 wherein said transmitting unit has at least two infra-red emitting units, with at least one infra-red emitting unit mounted on each side of said boat.

* * * * *